US006331512B1

(12) United States Patent
Foote et al.

(10) Patent No.: US 6,331,512 B1
(45) Date of Patent: Dec. 18, 2001

(54) PHOSPHATE-FREE AUTOMATIC DISHWASHING DETERGENT

(75) Inventors: Michael R. Foote, Ada; Ernie Brumbaugh, Rockford, both of MI (US)

(73) Assignee: Amway Corporation, Ada, MI (US)

( * ) Notice: Subject to any disclaimer, the term of this patent is extended or adjusted under 35 U.S.C. 154(b) by 0 days.

(21) Appl. No.: 09/603,135

(22) Filed: Jun. 23, 2000

Related U.S. Application Data

(60) Provisional application No. 60/157,345, filed on Sep. 29, 1999.

(51) Int. Cl.[7] ..... C11D 3/00; C11D 3/22; C11D 3/08; C11D 3/39

(52) U.S. Cl. ..... 510/226; 510/230; 510/374; 510/378

(58) Field of Search ..... 510/226, 230, 510/374, 378

(56) References Cited

U.S. PATENT DOCUMENTS

| | | | | |
|---|---|---|---|---|
| 5,169,553 | | 12/1992 | Durbut et al. . | |
| 5,173,207 | | 12/1992 | Drapier et al. . | |
| 5,240,632 | * | 8/1993 | Brumbaugh | 252/95 |
| 5,423,997 | * | 6/1995 | Ahmed et al. | 252/99 |
| 5,468,411 | | 11/1995 | Dixit et al. . | |
| 5,597,789 | | 1/1997 | Sadlowski . | |
| 5,599,781 | * | 2/1997 | Haeggberg et al. | 510/220 |
| 5,703,027 | | 12/1997 | Caravajal et al. . | |

* cited by examiner

*Primary Examiner*—Gregory Delcotto
*Assistant Examiner*—John M Petruncio
(74) *Attorney, Agent, or Firm*—Amway Corporation

(57) ABSTRACT

The present invention relates generally to compositions for use in machine dishwashers to facilitate the cleaning of dishes and the like. More particularly, the present invention relates to compositions, which reduce the dissolution of ions from glass surfaces on articles cleaned in machine dishwashers.

14 Claims, No Drawings

PHOSPHATE-FREE AUTOMATIC DISHWASHING DETERGENT

This is a continuation-in-part of U.S. Provisional Patent Application No. 60/157,345 filed on Sep. 29, 1999.

FIELD OF THE INVENTION

The present invention relates to highly concentrated compositions for use in automatic machine dishwashers to facilitate the cleaning of dishes and the like. More particularly, the present invention relates to phosphate and chlorine free compositions for use in soft and moderately hard water conditions which are effective to reduce the dissolution of ions from glass surfaces on articles cleaned in automatic dishwashers.

BACKGROUND OF THE INVENTION

Automatic machine dishwashers are widely used to clean soiled dishes, cooking utensils and other containers for serving and preparing food, such as plates, cups, glasses, silverware, pots, pans, etc., generically referred to as "dishes". While the construction and composition of dishes vary widely, most usually have glossy, solid surfaces on which the presence of dried water spots is readily noticeable. These dried water spots are aesthetically unappealing and thus methods and compositions for reducing their number and size are of great concern to the detergent industry as well as to the consumer.

Typical automatic dishwashers operate by subjecting food-soiled dishes and the like to alternating wash and rinse cycles inside a closed washing chamber. Spray nozzles inside the chamber direct powerful streams of hot wash liquor and rinse water onto the soiled dish surfaces. The force exerted by these pressurized water streams removes a considerable amount of food residue. There is, however, a substantial amount of food residue that resists dislodgment by the water jets. It is known that by adding certain additives to an automatic dishwashing detergent composition, and thereby to the wash water, a much greater quantity of food soil can be removed from soiled article surfaces during the washing cycle.

One type of additive that is often added to automatic dishwashing detergent compositions is a detergent builder. Typical detergent builders include complex phosphates, carbonates, sulfates and silicates. Detergent builders compliment the detersive action of surfactants such as by sequestering certain metallic ions which are present in most water sources. Phosphate-based detergent builders reduce hard water film formation caused by the deposition of metallic precipitates. Another additive included in automatic dishwashing compositions are alkalinity builders. Alkalinity builders provide alkaline cleaning power which is particularly important in automatic dishwashing compositions since, by its very nature, automatic dishwashing does not provide the mechanical action of hand dishwashing. Since physical contact with the wash liquor by the consumer does not occur when dishes are cleaned in a machine dishwasher, alkalinity builders are especially suitable for use in automatic dishwashing detergents. Other additives typically found in an automatic dishwashing detergent include bleaches, enzymes, corrosion inhibitors, surfactants, defoamers, polymers and bleach activators.

However, the addition of chemicals to complement the detersive action of the surfactants used in automatic dishwashing detergents has disadvantages. In particular the addition of complex phosphates to the dishwashing detergent formulation results in soft water corrosion of select surfaces in glassware. Therefore, the addition of phosphates to commercial dishwashing compositions, has the tendency to exacerbate the corrosion of commercial glassware. It is also well known that phosphates contribute to the eutrophication of rivers and lakes. It is therefore desirable to provide a dishwashing detergent that does not use phosphates, therefore, preventing the corrosion of glassware and prevent pollution of the environment while still maintaining acceptable cleaning properties.

SUMMARY OF THE INVENTION

The present invention relates to highly concentrated automatic dishwashing detergent compositions that are free of phosphate compounds, thereby reducing the potential for soft water etching when the detergent composition is used under soft or moderately hard water conditions. The automatic detergent composition of the present invention includes a non-traditional base which is free of any phosphate and carbonate building agents. The preferred base is any alkali metal silicates such as sodium and potassium silicate, disilicates or polymer.

The detergent composition further includes a non-ionic surfactant and a water spot reduction composition comprised of a bleaching agent, and a proteolytic enzyme and a polyacrylate. Preferably the non-ionic surfactant comprises about 5% to 15% by weight of the composition and has low foaming characteristics. Fatty alcohol ethoxylate/propoxylates and ethylene oxide/propylene oxide block polymers are well suited for use in this invention. Preferably, the bleaching agent is an oxygen bleach selected from the group consisting of alkaline metal perborates, percarbonates, persulfates and perphosphates. The preferred bleaching agent is sodium perborate monohydrate, and comprises about 20% to 30% by weight of the detergent composition. Preferably, the proteolytic enzyme is alkaline stable and comprises about 1% to 5% of the detergent composition. In a preferred embodiment, the polyacrylate is sodium polyacrylate having a molecular weight from about 500 to 200,000 and comprises about 10% to 20% of the detergent composition.

DESCRIPTION OF THE PREFERRED EMBODIMENT

In accordance with the present invention, a detergent is provided for use in a machine dishwasher that significantly reduces the soft water corrosion of glassware that may occur due to the use of phosphates. The formulations of the present invention provide a highly concentrated, phosphate and chlorine free automatic dishwashing detergent that is equal to or superior in cleaning performance to the current phosphate-containing automatic dishwashing detergent formulations. The automatic dishwashing detergent of this invention may be supplied as a free flowing powder or compacted into individual tablets.

The automatic dishwashing detergent of this invention is comprised of an alkali metal silicate, a non-ionic surfactant, a water spot reduction composition, and optionally, fragrance and additional cleaning agents such as enzymes (amaylase, lipase, etc). A water spot reduction composition suitable for use in this invention is comprised of an oxygen bleach, a proteolytic enzyme, and a polyacrylate. This particular water spot reduction composition is described in U.S. Pat. No. 5,240,632, herein incorporated by reference. In that invention, it was found that the water spot reduction composition was effective to reduce water spotting on washed article surfaces when used in combination with standard automatic dishwashing detergent components including phosphate, carbonate and sulfate compounds. Applicants have further found that this same water spot reduction composition, when combined with an alkalinity builder which is free of any phosphate or carbonate compounds is equally effective to reduce water spots and is more effective in reducing glass etching.

The alkalinity builder suitable for use in this invention is any alkali metal silicate. Suitable examples include, but are not limited to, silicates or metasilicates of either sodium or potassium. Preferably a sodium silicate or sodium metasilicate is used. Examples of sodium silicates include $Na_2SiO_3$, $Na_6Si_2O_7$, and $Na_2Si_3O_7$. Sodium silicates which have a $SiO_2$ to $Na_2O$ ratio of from 0.5:1 to 4:1 are preferred for use herein. Sodium metasilicates, such as $Na_2O_3Si$, are usually prepared from sand ($SiO_2$) and soda ash ($Na_2CO_3$). The preferred alkali metal silicate for use in this invention is sodium silicate, which is commercially available under the trade name Britesil H-20. In a preferred embodiment of the invention, the alkali metal silicate comprises about 1% to 60% by weight of the detergent composition. More preferably, the alkali metal silicate comprises about 50% of the detergent composition.

Preferred oxygen bleaches for providing a source of available oxygen for use in the present invention include water soluble percompounds such as alkaline metal perborates, percarbonates, persulfates and perphosphates as well as alkaline earth perphosphates, percarbonates and persulfates. Suitable alkali metal perborates include potassium perborate, sodium perborate tetrahydrate, and sodium perborate monohydrate. Most preferred oxygen bleaches for use in the present invention are the sodium perborates and in particular, sodium perborate monohydrate. Other suitable compounds which provide the necessary source of available oxygen for use in this invention are hydrogen peroxide and its inorganic adducts which include the aforementioned alkali metal perborates, persulfates and percarbonates. In general, any organic peracid source of available oxygen is suitable for use in the present invention. Compatible mixtures of these oxygen bleaches may be suitable for use herein. It will also be apparent to those skilled in the art that oxygen bleach activators may be suitable for use in the practice of the present invention.

Suitable proteolytic enzymes for use in the present invention include trypsin, chymotrypsin, pepsin, papain, bromelin, carboxylase, collagenase, keratinase, elastase, amino peptidase, subtilisin and aspergillopeptidase. The subtilisin enzymes derived from bacillus subtillis are especially preferred, such as Esperase 6.0 T sold by Novo Industries which has a minimum enzyme activity of 6.0 KNPU/g. Proteolytic enzymes suited for use herein are active in a pH range of from about 4 to about 12 at a temperature of from about 50° F. to about 200° F. Although suitable proteolytic enzymes can be obtained from many commercial sources, trade formulations such as Alcalase, sold by Novo Industries of Copenhagen, Denmark; Maxatase, sold by Koninklijke Gist-Brocades NV of Delft, Holland; Protease AP, sold by Schweizerische Ferment AG of Basel, Switzerland; and, Esperase and Savinase, also sold by Novo Industries, are suitable in the present invention.

Suitable polyacrylates for use herein include, but are not limited to, polymers and copolymers of acrylic acid, maleic anhydride, methacrylic acid, esters of these acids or acrylonitrile. Preferred polymers of the above group are sodium polyacrylate and sodium polyhydroxyacrylate. It is preferred that the polyacrylates used in the present invention have a molecular weight of from about 500 to about 200,000, and more preferably from about 1,000 to about 10,000. It is permissible for use herein to use a mixture of the various preferred polyacrylates as the polyacrylate component of the present composition.

A preferred embodiment of the present invention is shown below in Table 1.

TABLE 1

| Ingredient | % by Weight |
|---|---|
| Sodium Silicate | 49.09 |
| Nonionic Surfactant | 09.25 |
| Sodium Perborate Monohydrate | 24.05 |
| Alkaline Stable Protease | 3.00 |
| Sodium Polyacrylate | 14.61 |

Another preferred embodiment would be:

| Ingredient | % by Weight |
|---|---|
| Sodium Silicate | 48.49 |
| Nonionic Surfactant | 9.25 |
| Sodium Perborate Monohydrate | 24.05 |
| Alkaline Stable Protease | 3.00 |
| Alkaline Stable Amaylase | 0.60 |
| Sodium Polyacrylate | 14.61 |

We claim:

1. A concentrated automatic dishwashing composition comprising:

a) about 1% to 80% of an alkali metal silicate;

b) about 1% to 20% of a nonionic surfactant;

c) about 5% to 50% of an oxygen-containing bleaching agent;

d) about 0.5% to 10% of one or more alkaline stable enzyme; and e) about 5% to 30% of a polyacrylate, wherein the composition is free of any carbonate, phosphate, and chlorine compounds.

2. A concentrated automatic dishwashing composition comprising:

(a) about 49.09% of an alkali metal silicate, (b) about 9.25% of a nonionic surfactant;

(c) about 24.05% of an oxygen-containing bleaching agent;

(d) about 3% of an alkaline stable enzyme; and (e) about 14.61% sodium polyacrylate, wherein the composition is free of any carbonate or phosphate compounds.

3. A concentrated automatic dishwashing composition comprising:

(a) about 48.49% of Sodium Silicate;

(b) about 9.25% of Nonionic Surfactant;

(c) about 24.05% of Sodium Perborate Monohydrate;

(d) about 3% of Alkaline Stable Protease;

(e) about 0.60% of Alkaline Stable amylase; and (f) about 14.61% of Sodium Polyacrylate;

wherein the composition is free of any carbonate, phosphate and chlorine compounds.

4. The automatic dishwashing composition of claim 1 wherein the alkali metal silicate is selected from the group consisting of sodium silicate, sodium metasilicate, potassium silicate, and potassium metasilicate.

5. The automatic dishwashing composition of claim 4 wherein the alkali metal silicate is sodium silicate.

6. The automatic dishwashing composition of claim 4 wherein the alkali metal silicate is sodium metasilicate.

7. The automatic dishwashing composition of claim 1 wherein the nonionic surfactant is selected from the group consisting of fatty alcohol ethoxylates, fatty alcohol propoxylates, and ethylene oxide/propylene oxide polymers.

8. The automatic dishwashing composition of claim 1 wherein the oxygen-containing bleaching agent is selected from the group consisting of potassium perborate, sodium perborate tetrahydrate, and sodium perborate monohydrate.

9. The automatic dishwashing composition of claim 8 wherein the oxygen-containing bleaching agent is sodium perborate monohydrate.

10. The automatic dishwashing composition of claim 1 wherein the alkaline stable enzyme is selected from the group consisting of trypsin, chymotrypsin, pepsin, papain, bromelin, carboxylase, collagenase, keratinase, elastase, amino peptidase, substilisin, and aspergillopeptidase.

11. The automatic dishwashing composition of claim 10 wherein the alkaline stable enzyme is substilisin.

12. The automatic dishwashing composition of claim 1 wherein the polyacrylate is selected from the group consisting of polymers and copolymers of acrylic acid, maleic anhydride, methacrylic acid, esters of acrylic acid, and acrylonitrile.

13. The automatic dishwashing composition of claim 1 wherein the polyacrylate has a molecular weight from about 500 to 200,000.

14. The automatic dishwashing composition of claim 12 wherein the polyacrylate is sodium polyacrylate.

* * * * *